US005595811A

United States Patent [19]

Stout, Jr.

[11] Patent Number: 5,595,811

[45] Date of Patent: Jan. 21, 1997

[54] PACKAGING MATERIAL

[76] Inventor: William A. Stout, Jr., 11410 E. Shore Dr., Delton, Mich. 49046

[21] Appl. No.: 299,562

[22] Filed: Sep. 1, 1994

Related U.S. Application Data

[63] Continuation-in-part of Ser. No. 829,726, Jan. 31, 1992, abandoned.

[51] Int. Cl.[6] ..... B65D 81/16

[52] U.S. Cl. ..... 428/181; 428/131; 428/163; 428/174; 428/537.5; 206/521; 206/521.9; 206/584; 206/814; 206/593

[58] Field of Search ..... 206/521, 521.9, 206/523, 584, 814, 46, 592, 594; 428/131, 163, 174, 178, 181, 188, 537.5; 493/967

[56] References Cited

U.S. PATENT DOCUMENTS

| | | | |
|---|---|---|---|
| 2,079,374 | 5/1937 | Kent | 252/62 |
| 2,642,916 | 6/1953 | Exline, Jr. | 72/465 |
| 2,685,827 | 8/1954 | Mason | 493/464 |
| 2,685,828 | 8/1954 | Mason et al. | 493/464 |
| 2,778,558 | 1/1957 | Butterfield | 206/521.1 |
| 3,550,421 | 12/1970 | Stakel | 72/327 |
| 3,603,499 | 9/1971 | Snow | 206/521.8 |
| 3,650,877 | 3/1972 | Johnson | 428/222 |
| 3,933,959 | 1/1976 | Skochdopole et al. | 264/45.5 |
| 3,975,564 | 8/1976 | Jones | 428/174 |
| 4,027,064 | 5/1977 | Bussey, Jr. | 428/357 |
| 4,075,107 | 2/1978 | Smith | 210/493.1 |
| 4,094,234 | 6/1978 | Olney et al. | 99/310 |
| 4,098,177 | 7/1978 | Olney et al. | 99/310 |
| 4,109,040 | 8/1978 | Ottaviano | 428/129 |
| 4,997,091 | 3/1991 | McCrea | 206/584 |
| 5,151,312 | 9/1992 | Boeri | 428/156 |

FOREIGN PATENT DOCUMENTS

| | | |
|---|---|---|
| 953512 | 12/1949 | France . |
| 2201622 | 9/1988 | United Kingdom . |

*Primary Examiner*—James J. Seidleck
*Assistant Examiner*—Michael A. Williamson
*Attorney, Agent, or Firm*—Flynn, Thiel, Boutell & Tanis, P.C.

[57] ABSTRACT

A free-flowing dunnage packaging material formed from individual dunnage elements which are individually constructed from small sheets of paper, such as small paper squares, with the sheets being preformed into cup-like configurations so that such material, when used to fill a space or region between an article and a surrounding confinement, possesses sufficient strength to permit safe but cushioned support of the article.

23 Claims, 7 Drawing Sheets

PACKAGING MATERIAL

CROSS REFERENCE TO RELATED APPLICATION

This is a continuation-in-part of U.S. patent application Ser. No. 07/829,726 filed Jan. 31, 1992, now abandoned and entitled "PACKAGING MATERIAL".

FIELD OF THE INVENTION

This invention relates to an improved free-flowing dunnage packaging material which can be arranged in a haphazard relationship and packed around an article for holding the article within a box or container.

BACKGROUND OF THE INVENTION

Numerous dunnage packaging materials have been developed for providing protective and cushioned packing of articles within confining boxes or containers. One of the more commonly utilized dunnage packaging materials is the polystyrene "peanut" or bead. These foamed plastic packaging elements have been extensively utilized to provide protective cushioning of articles within outer containers to withstand the abuses encountered in transport. These plastic packaging elements, however, are undesirable due to handling and disposal difficulties. More specifically, the plastic packaging elements do not readily degrade so that disposal is a significant environmental problem.

Other known packaging materials which are commonly utilized include plastic bubble wrap, plastic foam sheets having embedded air cells, and padded paper packaging involving thick and layered fluff paper having air pockets therein. These latter packaging materials are all more limited in their usability, however, since they are generally created in sheet form and do not readily adapt to the shapes and contours of either the article or the container. Further, the plastic sheets also create an environmental disposal problem.

Shredded paper has also been used as a dunnage packaging material, although such material has met with dislike in many industries due tO the difficulties associated with handling of the material both during packaging and unpackaging, and the dust problem is created when using such material.

Accordingly, it is an object of the present invention to provide an improved free-flowing dunnage packaging material which is believed to improve upon and specifically overcome many of the disadvantages associated with known dunnage materials of the types discussed above.

More specifically, this invention relates to an improved free-flowing dunnage packaging material formed from individual dunnage elements which are individually constructed from small sheets of paper, such as small paper squares, with the sheets being preformed into a cup-like configurations so that such material, when used to fill a space or region between an article and a surrounding confinement, possesses sufficient strength to permit safe but cushioned support of the article, particularly during transport. This improved packaging material is particularly desirable with respect to ultimate disposal thereof since the paper readily degrades, and can be compacted or compressed into a small lightweight mass. This improved dunnage material can also be economically produced, can utilize recycled paper, and can be readily and conveniently handled without creating dust or other environmental problems, and is lightweight so as to not significantly increase overall shipping weight.

In the improved dunnage packaging material, as aforesaid, the paper cup-shaped dunnage element in one embodiment includes a generally flat base integrally and monolithically connected to a surrounding skirt which projects outwardly from one side of the base. This skirt is defined by a plurality of side panels which join to and extend around the base, with each side panel preferably being of a generally grooved or concaved horizontal cross section, with the edges of adjacent side panels being joined by convex rounded corner portions. The side panels preferably terminate in an outer pointed corner at an outer free end thereof so that the side panel is of greater length substantially along the center thereof than at the rounded edges. The resulting dunnage element hence possesses sufficient strength and durability, particularly when a large number of such elements are used to fill an open space or region between an article and a container, to provide protective yet cushioned support of the article. The skirt on the elements, and particularly the creation of the skirt by a plurality of deformed or concaved side panels, and the manner in which the elements randomly interfit and interlock when disposed within a container, provide the strength and durability necessary to support the article, but at the same time the randomly oriented collection of dunnage elements is able to provide resilient cushioning of the article due to the air spaces created by the skirts and resilient deformation of the skirts.

In the improved dunnage packaging material, as aforesaid, the individual elements are preferably initially formed from small paper squares so that the resulting skirt of the element is defined by four serially connected side panels, with each side panel being provided with a concave groove extending centrally through the longitudinal extent thereof and terminating at a corner as defined by one of the original corners of the paper square. The dunnage element, however, can also be defined by a paper sheet having three sides and corners, such as a sheet formed as a equilateral triangle, since the resulting dunnage element thus functions in generally the same manner except that the skirt is defined by three side panels, rather than four.

In the improved dunnage packaging material, as aforesaid, the paper cup-shaped dunnage element in a preferred embodiment includes a generally flat base integrally and monolithically connected to a surrounding skirt which projects outwardly from one side of the base. This skirt is defined by a plurality of side panels which join to and extend around the base. Each side panel includes an outer sidewall part which is circumferentially elongated and spirals outwardly partway around the base, and at its edge is folded inwardly to define an inner sidewall part which projects circumferentially reversely so as to partially overlap the outer sidewall part. This inner sidewall part terminates at a reverse fold line which joins to the edge of the outer sidewall part of the next adjacent side panel. The plurality of side panels extend circumferentially around the base and create a pinwheel-shaped cross section which, depending upon the tightness thereof, approaches a cylindrical configuration.

In the improved dunnage packaging material of the preferred embodiment, as aforesaid, the individual elements are preferably initially formed from small paper squares so that the resulting skirt of the element is defined by four serially connected side panels, and the resulting element when deformed into the pinwheel shape has the free outer edge of the skirt, at the open end thereof, defined by the edge of the paper square so that the free edge of the element has a sawtooth shaped configuration, and each side panel at the free edge thereof is pointed as defined by one of the corners of the paper square. This configuration of the dunnage element provides significant strength and durability in that each element traps or defines a significant open air space, and yet the element possesses sufficient strength as to enable resilient and cushioned support for objects packed within a collection of such elements, which elements are capable of being randomly oriented to provide the desired resilient cushioning of the object due to the resilient spaces created by the skirts and the resilient deformation of the skirts.

The present invention also relates to an improved process for making a dunnage packaging material, and specifically an apparatus for making a dunnage element of the type described above. In the process and apparatus, the paper square is positioned on an extruder which defines an interior channel, and a punch engages the paper square and forces it downwardly into the channel to form the sheet into the cup-shaped dunnage element.

The structure and function of the present invention, together with other objects and purposed thereof, will be apparent to persons familiar with dunnage packaging materials upon reading the following specification and inspecting the accompanying drawings.

Figure 1:
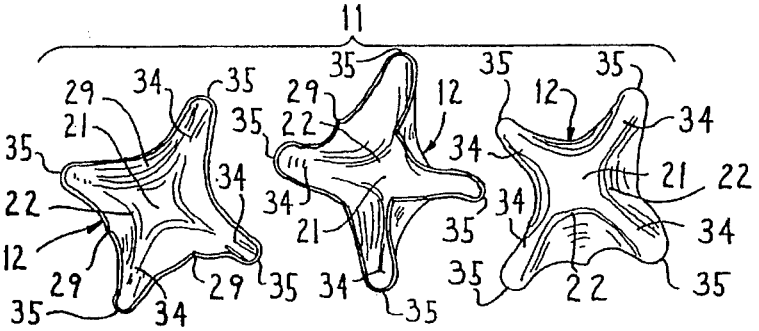
FIG. 1 is a perspective view illustrating the improved dunnage packaging material of the present invention, only three individual dunnage elements being shown in FIG. 1 for clarity of illustration.

Certain terminology will be used in the following description for convenience in reference only, and will not be limiting For example, the words "upwardly", "downwardly", "rightwardly" and "leftwardly" will refer to directions in the drawings to which reference is made. The words "inwardly" and "outwardly" will refer to directions toward and away from, respectively, the geometric center of the element or apparatus, or designated parts thereof. Said terminology will include the words specifically mentioned, derivatives thereof, and words of similar import.

DETAILED DESCRIPTION

Figure 2:
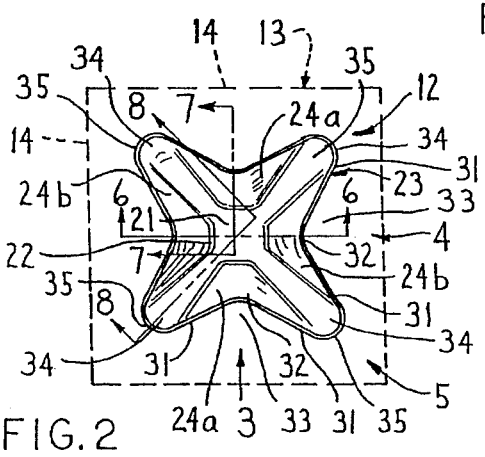
FIG. 2 is a top view of a typical dunnage element according to one embodiment of the present invention.

Referring to FIG. 1, there is illustrated a dunnage packaging material 11 according to one embodiment of the present invention, which material is a bulk and free-flowing material formed by a plurality of separate and substantially identical dunnage elements 12. Each of the dunnage elements 12 is constructed entirely from a monolithic, one-piece, thin, flat paper blank 13, as illustrated by dotted lines in FIG. 2. This blank 13 is suitably deformed, as explained hereinafter, to form the three-dimensional dunnage element 12. This element 12, when oriented as illustrated by the drawings, is of a generally upwardly-opening cup-shaped configuration, although when viewed in plan view it resembles a four-pointed star.

The dunnage element 12, as shown by FIGS. 2–8, includes a generally flat central base portion 21 which has a number of sides 22 which substantially corresponds to the number of generally straight sides or edges 14 provided on the blank 13. The dunnage element 12 also has an annular skirt portion 23 which joins to the base portion 21 around the entirety of the sides or periphery thereof and projects upwardly from the base portion and cooperates therewith to define a generally upwardly-opening cup-shaped configuration.

The annular skirt portion 23 is defined by a plurality of side panels 24 which are joined serially together in surrounding relationship to the base portion, with the number of side panels 24 preferably corresponding to the number of straight edges 14 associated with the blank 13. In the illustrated embodiment the blank 13 is generally square and has four edges 14, and the skirt portion 23 is defined by four side panels 24. Each one of the side panels corresponds to approximately one quarter of the blank 13, with this quarter encompassing a corner of the blank therein.

In FIGS. 2–8, one opposed pairs of side panels have been designated 24*a*, and this pair of side panels is joined together by a further pair of opposed side panels designated 24*b* so as to facilitate explanation and illustration. All of the side panels 24, however, are substantially identical.

Considering the configuration of the side panel 24, it includes a lower portion 26 which projects upwardly from one side 22 of the base portion 21. This lower portion 26 is of increasing horizontal width as it projects upwardly so as to define a generally trapezoidal configuration, with this lower portion 26 in turn joining integrally to an upper portion 27 which continues to project upwardly. This upper portion 27 is of a generally triangular configuration and is defined between upper free edges 28 which converge as they project upwardly for intersection at an uppermost tip or point 29, the latter corresponding to one of the corners of the blank 13.

The side panel 24 is deformed into a nonplanar configuration and is defined by a pair of sidewall portions 31 which converge inwardly toward one another, with these sidewall portions 31 being integrally joined by a rounded or smoothly curved concave apex portion 32. This apex portion 32 projects substantially centrally along the upright extent of the sidewall portion 24, and effectively starts at the tip 29 and projects downwardly to substantially the associated side 22 of the base portion 21. The pair of sidewall portions 31 cooperate with and diverge outwardly relative to the apex portion 32 so that the side panel 24, in horizontal cross section, has a generally shallow arcuate configuration which opens outwardly and defines a shallow groove or channel 33 which extends vertically of the side panel 24 and opens outwardly thereof.

The adjacent side panels, such as adjacent side panels **24*a* and 24*b*, are joined by edge portions 34. This edge portion 34, in horizontal cross section, is a smoothly curved or rounded corner which is convex (i.e., curves outwardly) and which defines a smooth and rounded transition between the sidewall portions 31 of the adjacent side panels 24*a* and 24*b*. This rounded edge 32** extends through an angle which closely approaches but is generally slightly less than 180°.

The rounded edge portion 34 projects upwardly from the base 21 through a limited vertical extent, and at the same time is inclined outwardly relative to the base 21 and relative to the vertical as it projects upwardly. This angle of incline between the elongate-direction of the edge portion 34 and a horizontal plane defined by the base portion 21 is normally about 45°, ±10°.

The upper end of the edge portion 34 terminates in a free edge 35 which is of a rounded configuration so as to smoothly join the adjacent upper sloped edges 28 of sidewardly-adjacent side panels **24*a* and 24*b*. The edge portions 35 are located at an elevation between the elevations of the points 29 and base 21, and more specifically the edge portions 35 are normally at an elevation which is approximately midway between the elevations of the points 29 and base 21**.

The blank 13 used for forming the dunnage element 12 is preferably cut from a thin sheet or web of paper, preferably recycled paper. The weight (i.e., thickness and/or stiffness) of the paper used for the blank 13 can be selected over a rather significant range of values, depending upon the desired properties of the dunnage packaging material. For example, by using heavier web or sheet material, then this will provide the resulting elements 12 when used as part of the bulk material 11 with greater supporting strength and resiliency for cushioning purposes, although heavier material is obviously more costly and somewhat more difficult to form. The weight and stiffness of the web or sheet material used for defining the blank should obviously be selected according to the anticipated usage. For use in packaging and protecting very light articles, then the elements 12 can be formed from rather light paper. Conversely, for heavier articles the elements 12 can be formed from heavier paper. It is contemplated that, for best results, the dunnage elements 12 should be formed from paper in the range of from 26 pounds to 65 pounds, and preferably about 40 pounds. The paper web or sheet material used for forming the blanks is preferably referred to as "medium" namely the material used for forming the fluted layer in laminated corrugated paperboard.

Figure 9:
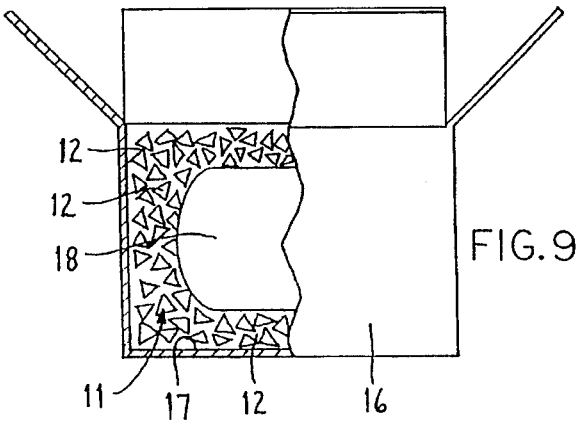
FIG. 9 is a diagrammatic elevational view, partially in cross section, illustrating the manner in which the dunnage packaging material can be utilized for supporting an article within a container such as a shipping box.

Reference is now made to FIG. 9 which diagrammatically illustrates a typical manner of use. An article or object 18 is intended to be positioned within the compartment 17 of a box or container 16 in such manner as to be safely supported in a cushioned manner spaced from the sidewalls of the container. Thus, the open space or region between the article and the container sidewalls is filled with the flowable dunnage packaging material 11 so that the space is substantially filled with the dunnage material. This provides for proper cushioned support of the article in spaced relationship from the sidewalls of the container, and provides sufficient cushioning and resiliency as to provide protection for the article, such as during handling or transport thereof.

Further, during initial packaging, the dunnage material 11 can be readily manually handled and readily freely flows into the container so as to permit filling of the open space or region. Likewise, when unpacking is desired, the material 11 can be readily manually removed from the container, or poured from the container, depending upon whatever mode of unpacking is selected. The material 11 can be collected and reused, or can be readily disposed of if desired. If disposed of, the elements 12 defining the material 11 can be readily compressed into a small but lightweight mass so as to facilitate disposal thereof. Further, since the elements 12 are constructed of paper, the elements will readily degrade.

Figure 10:
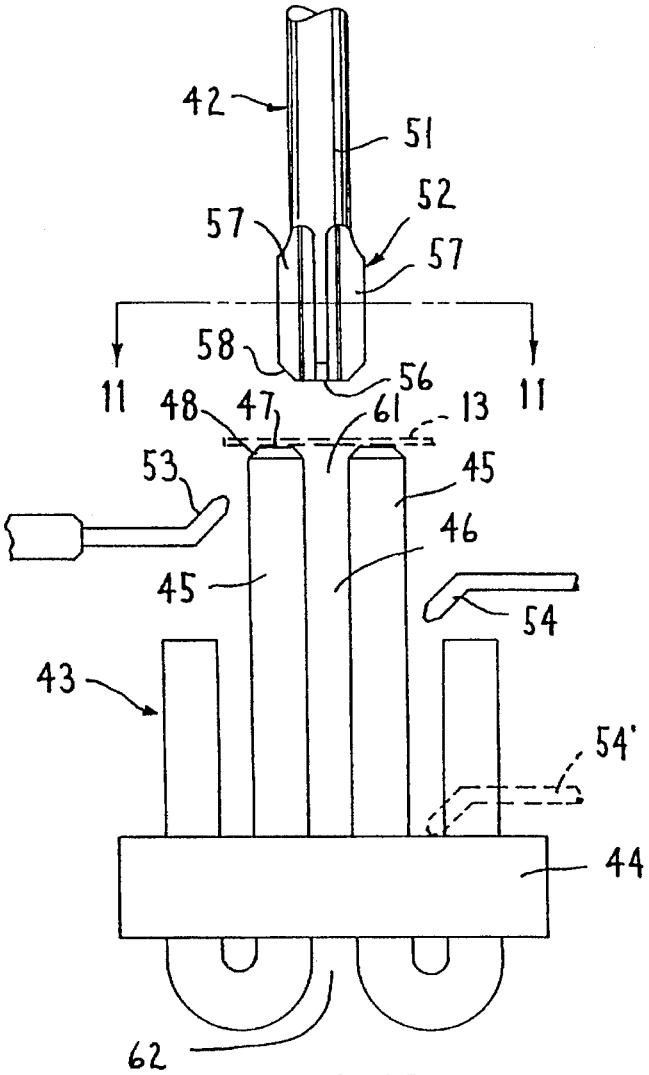
FIG. 10 is a fragmentary elevational view which illustrates the extruding apparatus and process for forming the dunnage element.
Figure 11:
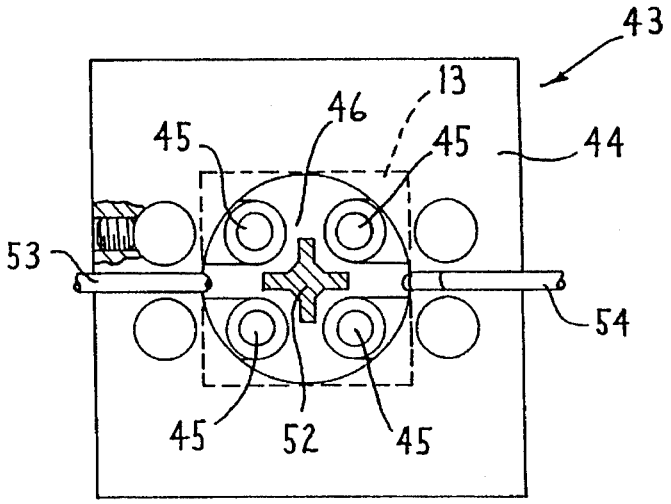
FIG. 11 is a view taken substantially along line XI—XI in FIG. 10.
Figure 12:
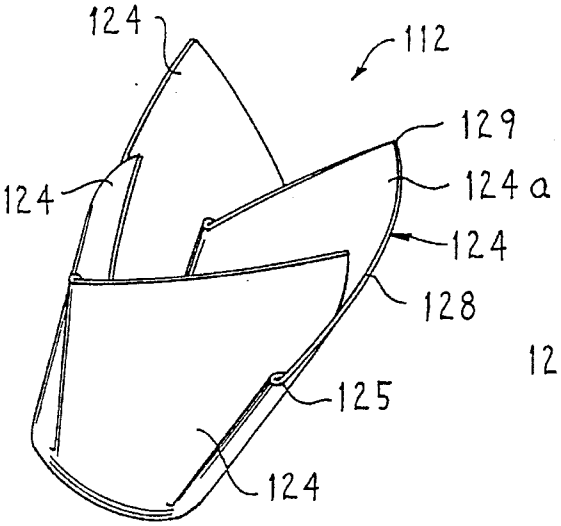
FIG. 12 is a top perspective view of a typical dunnage element according to a further and preferred embodiment of the invention.
Figure 13:
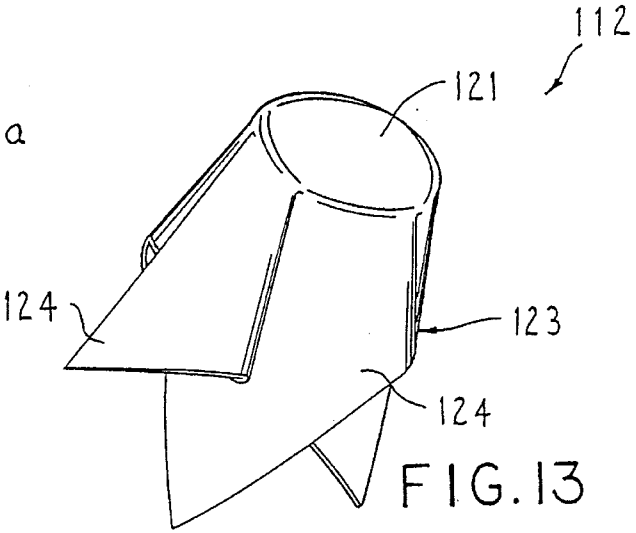
FIG. 13 is a bottom perspective view of the dunnage element shown in FIG. 12.
Figure 14:
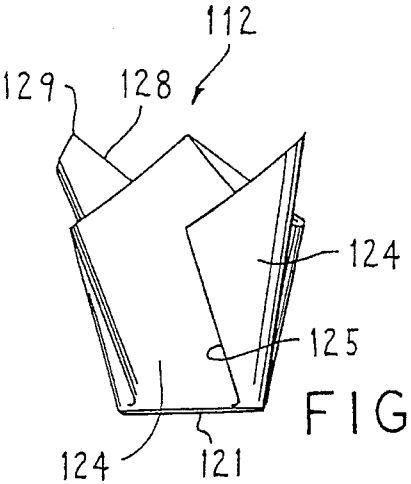
FIG. 14 is a side elevational view of the dunnage element of FIG. 12.

Referring now to FIGS. 10 and 11, there is illustrated a method and apparatus for permitting forming of the cup-like dunnage elements 12 from flat blanks 13. This apparatus includes a punch 42 which cooperates with an extruder 43 to permit forming of the dunnage element.

The extruder 43 includes a frame 44 having a set of forming posts 45 secured thereto, there being four such posts in the illustrated embodiment. The posts 45 project vertically upwardly in generally parallel relationship, and the posts are oriented so that the longitudinal axes thereof are disposed substantially at the corners of a square when viewed from above, whereby each adjacent pair of posts are uniformly spaced apart. The posts thus define a generally cross-shaped channel 46 extending vertically downwardly therethrough. The upper ends of the posts are provided with generally flat upper surfaces 47, although the upper corners of the posts are preferably chamfered as indicated at 48.

The punch 42 includes a vertically elongate support rod 51 which at an upper end is connected to a suitable vertical movement device (not shown), and a generally cross-shaped forming head 52 is defined on the lower free end of the rod 51, which head 52 is of a somewhat axially-elongated length. The cross-shaped cross section of the forming head 52 is sized so that it can move axially downwardly into the cross-shaped channel 46 with suitable and ample clearances being defined sidewardly between the head 52 and each of the posts 45, as illustrated in FIG. 11.

The forming apparatus also preferably includes a device, such as a nozzle 53 for moistening or wetting the blank 13 positioned on the upper ends of the posts prior to initiation of the deforming process. This nozzle 53 is connected to a source of water or steam so as to eject a stream of water, preferably steam, onto the blank 13 to effect saturation thereof with moisture prior to contact between the head 52 and the blank 13.

The forming apparatus also preferably includes means for assisting ejection of the formed element 13 from the lower end of the channel 46, which ejection device in the illustrated embodiment comprises a nozzle 54 capable of ejecting an airstream downwardly into the channel 46 at a location spaced a predetermined distance downwardly from the upper ends of the posts 45.

Posts 45 of extruder 43 are also heated, such as by electric heater wires (not shown) associated therewith, or connected to the frame 44. The posts 45 are preferably heated to a temperature of up to about 900° F.

To permit forming of the dunnage element 12 from the flat blank 13, the blank is initially positioned centrally over the tops of the set of posts 45 and is supported on the upper surfaces 47 thereof. A small amount of steam is then ejected from the nozzle 53 upwardly for contact with the blank 13 to effect moistening thereof. A conventional reciprocating drive device (not shown), such as a fluid pressure cylinder, is as coupled to the plunger 42 is then activated so that the head 52 moves downwardly and contacts the central portion of the blank 13, with further downward movement of the plunger causing the blank 13 to be pushed downwardly into the inlet end 61 of the channel 46 and hence deformed into the shape of the dunnage element 12. The plunger head 52 has a generally flat but square surface 56 defined on the middle of the lower free end thereof, and this surface results in formation of the base portion 21 of the dunnage element 12. The head 52 also has four longitudinally-elongated ribs 57 radiating radially outwardly thereof in uniformly spaced relationship thereon, and these individual ribs project partially into the regions defined between adjacent pairs of rods 45, as illustrated by FIG. 11. These ribs 57 cause parts of the paper blank to be deformed outwardly between corresponding pairs of posts 45, and result in formation of the rounded edge portions 34. The lower ends of these ribs 57 are chamfered or bevelled as indicated at 58 to prevent cutting or tearing of the paper.

Figure 5:
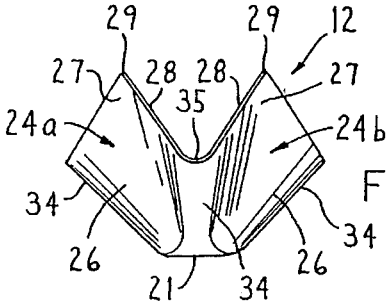
FIG. 5 is an elevational view of the dunnage element as taken generally in the direction of arrow 5 in FIG. 2.
Figure 6:
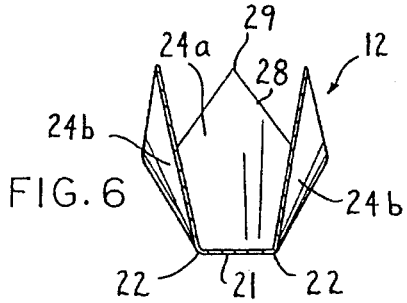
FIG. 6 is a sectional view taken substantially along line VI—VI in FIG. 2.
Figure 3:
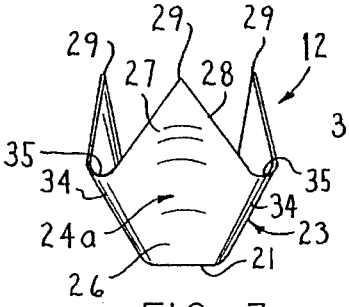
FIG. 3 is a side elevational view of the dunnage element as taken generally in the direction of arrow 3 in FIG. 2.
Figure 4:
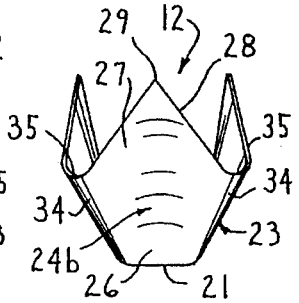
FIG. 4 is a side elevational view of the dunnage element as taken generally in the direction of arrow 4 in FIG. 2.
Figure 7:
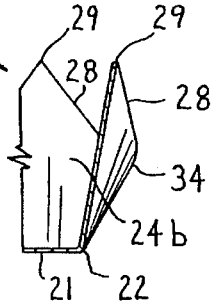
FIGS. 7 and 8 are sectional views taken substantially along lines VII—VII and VIII—VIII, respectively, in FIG. 2.
Figure 8:
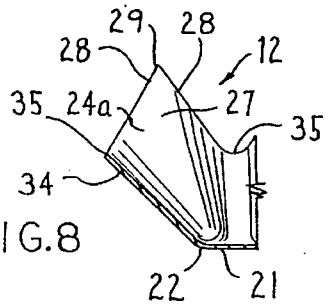

The plunger 42 is moved downwardly into the channel 46 through a distance sufficient to cause the entire blank 13 to be deformed downwardly into the channel 46, which distance at a least equals the overall height of the dunnage element 12 as illustrated by FIGS. 3–5. Thereafter the plunger 52 is retracted upwardly so as to be in a position to initiate a new forming operation.

After the element 12 has been pushed into and shaped within the channel 46, the element is maintained in the channel in contact with the heated rods for a short period of time, such as from about one to three seconds. This effects drying of the dunnage element 12 so that it retains its set or deformation when it is removed from the extruder.

After the plunger 42 has been retracted upwardly and the drying completed, then a suitable control activates an air pressure system to emit a pressurized airstream through the jet 54, which airstream is directed downwardly into the upwardly-oriented open interior of the cup-like dunnage element 12. The dunnage element 12, due to its confinement within the set of posts 45, acts like a parachute and catches the airstream therein, whereby the airstream moves the dunnage element downwardly and effects discharge thereof from the lower or discharge end 62 of the channel 46.

While the forming process described above relates to the formation, drying and subsequent discharge of individual dunnage elements in a sequential manner, it has also been experimentally observed that the forming process can be expedited to permit the dunnage elements to be formed at a more rapid rate by permitting a plurality of formed dunnage elements to be supported within the elongate channel 46, and engaged with the heated rods 45, at any one time. In such variation, the air discharge jet 54 is preferably disposed adjacent the discharge end 62 of the channel, such as indicated by dotted lines at 54'. Hence, as blanks 13 are sequentially positioned on the top of the posts 45 and then deformed downwardly into the channel 46, the deformed blanks sequentially partially nested one within the other to create a row of deformed elements 12, which elements are gradually pushed downwardly along the channel 46 toward the discharge end. When the front or lowermost element 12 associated with the row reaches the discharge end 62, then the jet 54' ejects an airstream which engages the lowermost element 12 and assists in discharge thereof from the apparatus. With this arrangement, the individual elements 12 remain in engagement with the heated rods 45 over a longer period of time so as to ensure complete drying thereof, and at the same time the individual blanks 13 can be supplied to the apparatus and deformed into the channel 46 at a more rapid rate.

While the forming process and apparatus described above uses a totally precut blank 13, it will be appreciated that the blank could be cut during the actual forming operation. For example, a paper strip of predetermined width could be fed across the posts and stopped, with an appropriate cutter being provided on the punch 42 so as to sever the blank from the strip substantially simultaneous with or just prior to the initial contact between the blank and the punch. Such arrangement would permit automation of the process by permitting automatic sequential feeding of the strip and severing of the blanks simultaneous with automatic actuation of the punch.

In addition, it is of course contemplated that the forming apparatus could have the capability of simultaneously deforming and/or severing several blanks during each punching cycle. Such could be accomplished by providing multiple punch arrangements disposed in side-by-side relationship, and utilizing shear devices which sever both the side and rear edges of the blanks simultaneous with activation of the punches so as to sever individual blanks from a larger sheet or roll, followed by automatic deformation of the severed blanks.

In the above embodiment of the invention as described above, the blank 13 is a four-sided rectangle, preferably a square, and the extruder involves a set of four posts 45 oriented to define the corners of a square which is somewhat smaller than the outside of the square defined by the periphery of the blank 13. During deformation each corner of the blank 13 is deformed inwardly and slides downwardly along an inner side surface of one of the posts 45, whereby the resulting dunnage element 12 has a number of side panels 24 (four in the illustrated embodiment) which corresponds to the number of extruder posts 45 and the number of sides 14 of the blank.

It will be appreciated, however, that the blank 13 may assume other configurations. For example, the blank could be a three-sided polygon such as a triangle, and preferably an equilateral triangle. In such case, a set of three posts 45 would be oriented with the axes thereof disposed to define the corners of a three-sided polygon (i.e. an equilateral triangle) somewhat smaller than the periphery of the triangular blank.

In the illustrated embodiment, the paper blank 13 is a square having sides 14 which are about 2 inches long, and the resulting dunnage element 12 when in the deformed condition of FIGS. 3–5 has a height of about 1¼ inch. A preferred size for the blank is a square having a side length in the range of from about 1¼ inches to about 2½ inches.

While the above description describes the dunnage element 12 in a vertical orientation whereby the cup-shaped configuration opens upwardly, it will be recognized that this description is solely for convenience in illustrating and describing the invention, and that the dunnage element in actuality will assume many different orientations, particularly when the bulk packaging material is in use.

Referring now to FIGS. 12–16, there is illustrated another and preferred embodiment of a dunnage element 112 according to the present invention. The element 112 is again formed from a monolithic, one-piece, thin, flat paper blank 13 which is suitably deformed, as explained hereinafter, to form the three-dimensional dunnage element 112. This element 112, when oriented as illustrated by the drawings, is of a generally upwardly-opening cup-shaped configuration, although when viewed in plan view it resembles a star wherein the points or vanes have all been angularly sidewardly deformed so as to resemble a pinwheel shape. Depending upon the degree to which the side panels or vanes of the element are compressed, the skirt of the dunnage element may approach a cylindrical configuration if the vanes or side panels remain in a tightly compressed condition as a result of the forming operation.

The dunnage element 112, as shown by FIGS. 12–16, includes a generally flat central base portion 121 which approximates a circle, although it will normally be somewhat distorted so as to have a configuration which is somewhere between a circle and a square, with the sides of the square being distorted and rounded so as to approach a circle. The dunnage element also has an annular skirt portion 123 which joins to the base portion around the entirety of the periphery 122 thereof, which annular skirt portion 123 projects outwardly (upwardly in FIG. 14) from the base portion and cooperates therewith to define a generally upwardly-opening cup-shaped configuration.

The annular skirt portion 123 is defined by a plurality of side panels 124 which are joined serially together in surrounding relationship to the base portion 121, with the number of side panels 124 typically corresponding to the number of straight edges associated with the blank 13 used to form the element. In the illustrated embodiment the blank is generally square and has four edges, and the skirt portion 123 is defined by four side panels 124. Each one of the side panels corresponds approximately to one quarter of the blank used for forming the element, with this quarter encompassing a corner of the blank.

Figure 15:
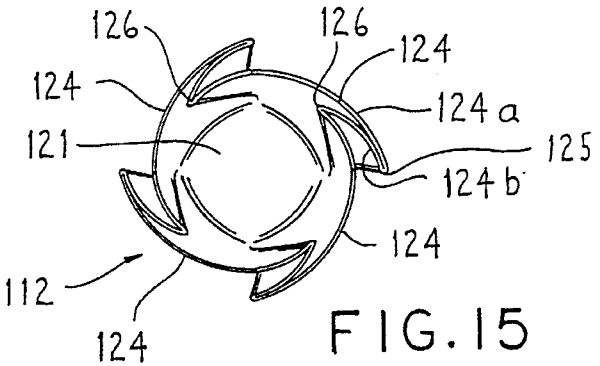
FIGS. 15 and 16 are respectively top and bottom views of the dunnage element shown in FIG. 14.

As shown in FIG. 15, each side panel 124 includes an outer sidewall part **124*a* which partially encircles the base portion 121 and typically spirals outwardly therearound. This outer side wall part 124*a* extends circumferentially of the base portion 121 through an angular extent which is approximately 360° divided by the number of side panels, this being about 90° in the illustrated embodiment. The outer sidewall part 124*a* connects, via a rather tight reverse fold 125 which projects from the base portion 121 longitudinally of the skirt so as to terminate at the free edge thereof, to an inner sidewall part 124*b* which is positioned inwardly of and partially overlaps the outer sidewall part 124*a*. This inner sidewall part 124*b* projects circumferentially and angles somewhat inwardly so that its other edge joins to a further rather tight reverse fold 126 which also projects longitudinally of the skirt. This fold 126 joins to the other edge of the outer sidewall part 124*a* associated with the next circumferentially adjacent side panel 124**.

The dunnage element 112, formed as illustrated and described above, has a free edge 128 which is generally continuous and of undulating or sawtooth-shape configuration, with each of the side panels 124 having a point 129 associated therewith, which point is defined by the corner of the original square blank. This point 129 is typically associated with the outer sidewall part **124*a* of each side panel 124**.

Figure 16:
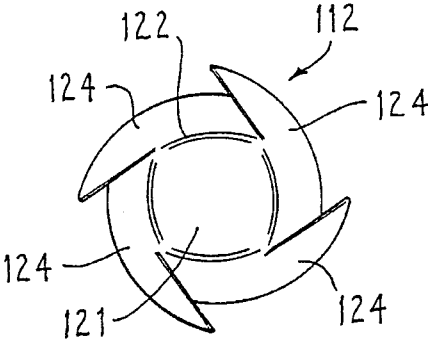
Figure 17:
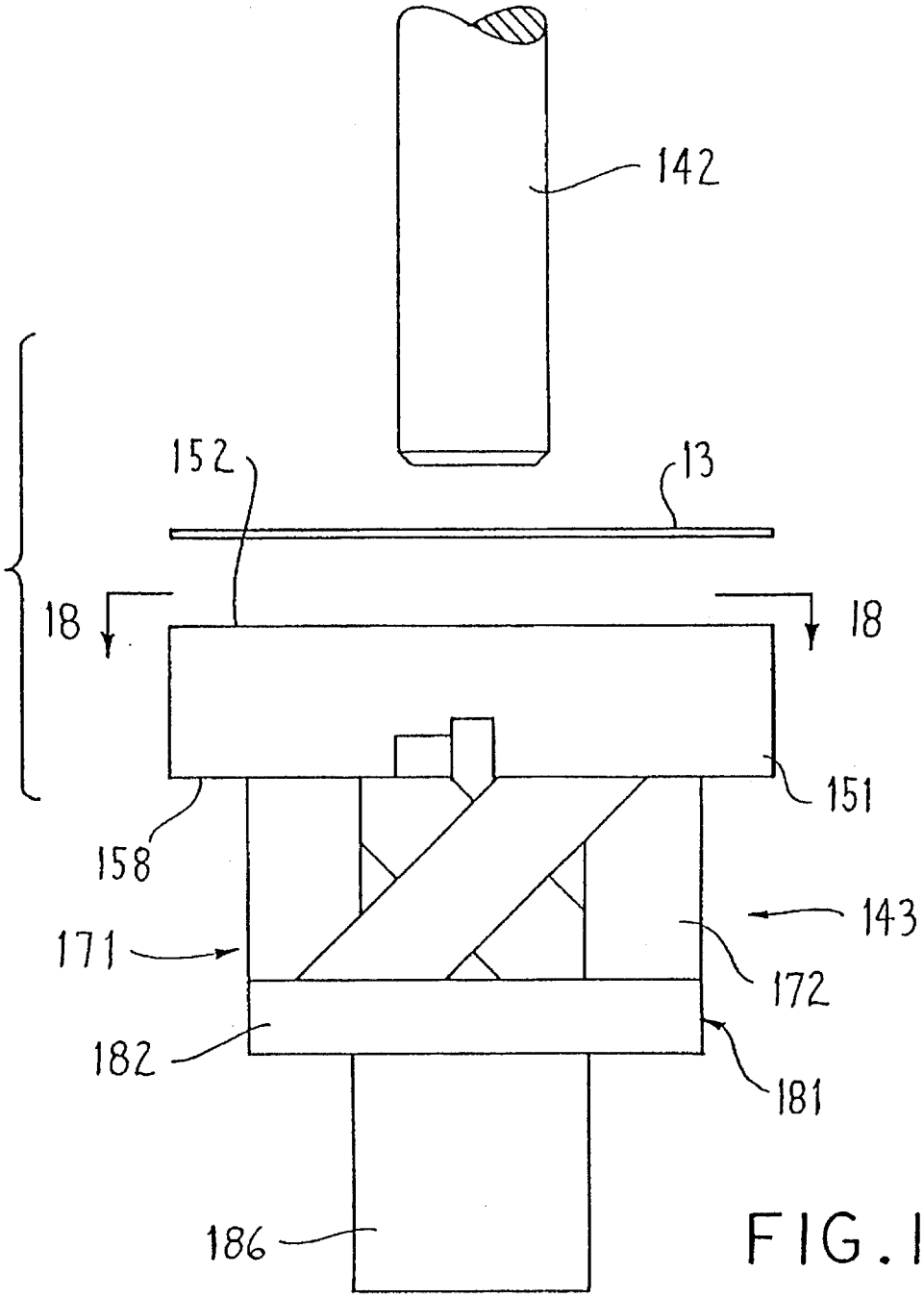
FIG. 17 is an elevational view which illustrates a forming apparatus and process for forming the dunnage element of FIGS. 12–16.
Figure 18:
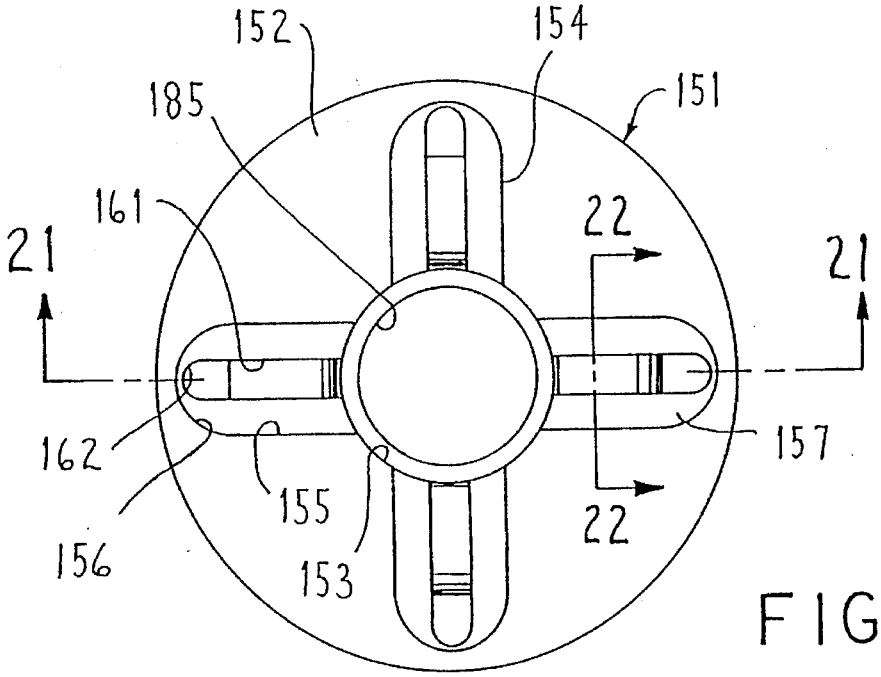
FIG. 18 is a top view taken generally along line 18—18 in FIG. 17.
Figure 19:
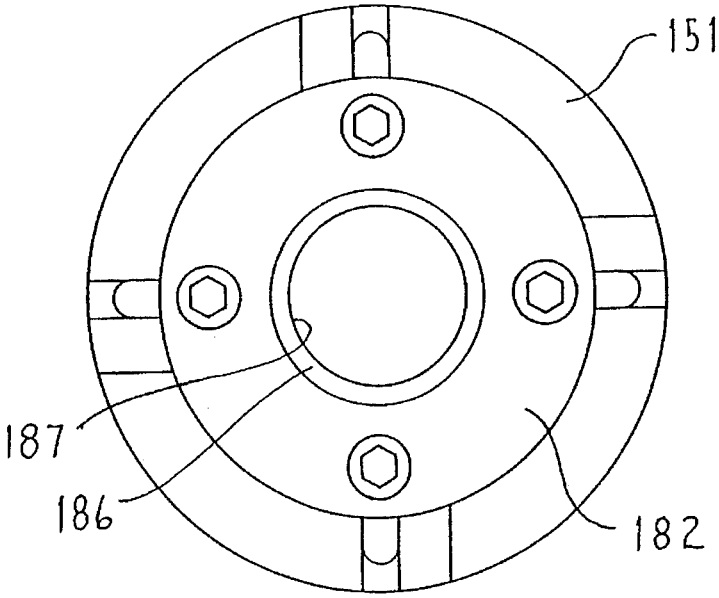
FIG. 19 is a bottom view of the apparatus shown in FIG. 18.
Figure 20:
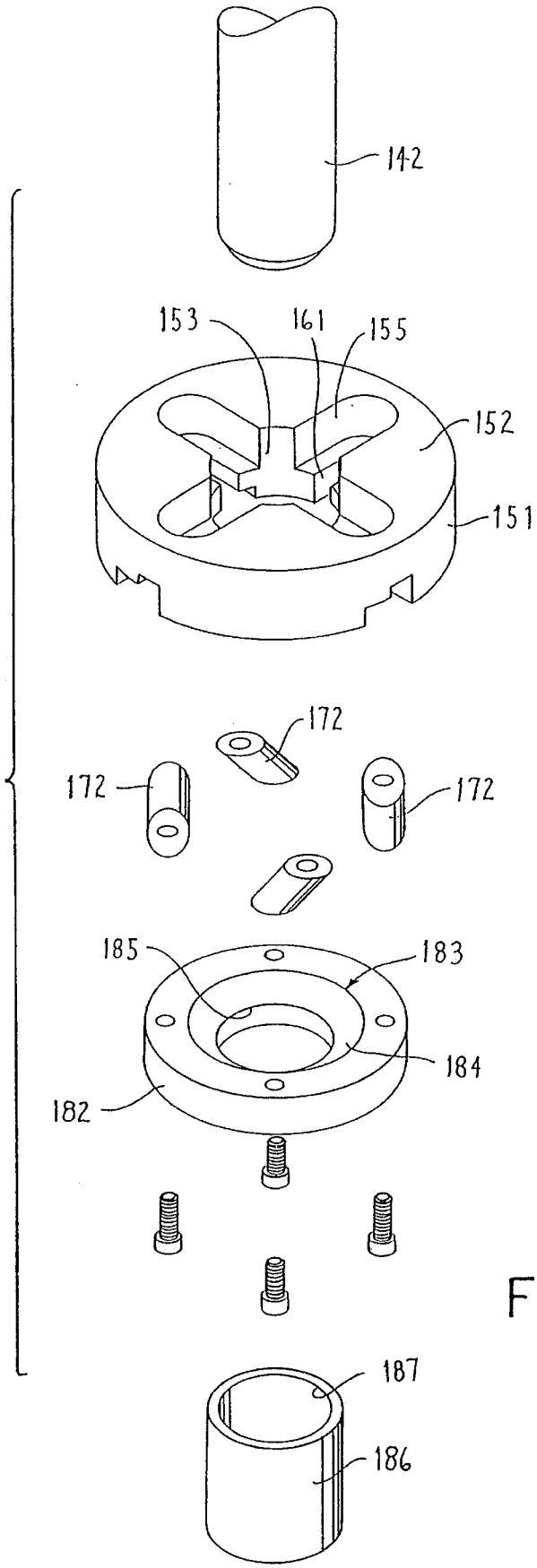
FIG. 20 is an exploded perspective view of the forming apparatus of FIG. 17.
Figure 21:
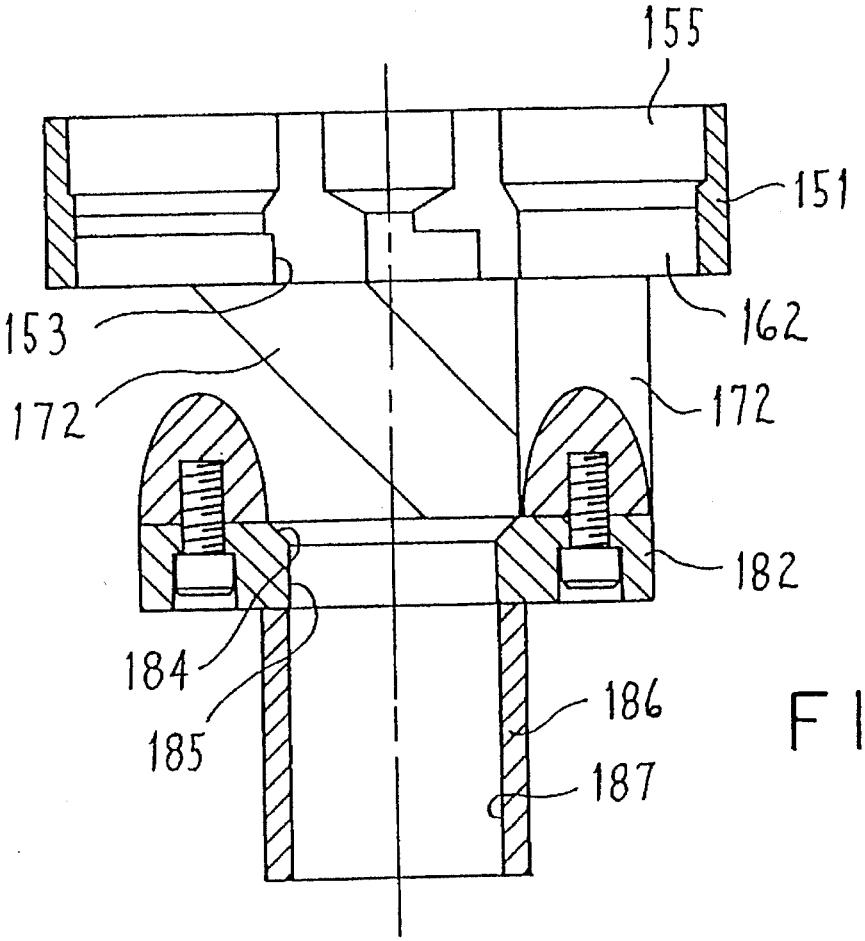
FIGS. 21 and 22 are sectional views respectively taken along lines 21—21 and 22—22 in FIG. 18.
Figure 22:
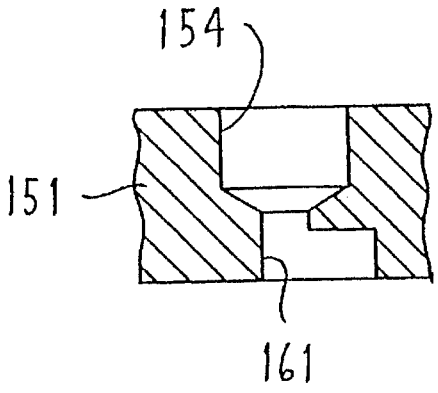

Each side panel 124, due to the forming thereof by the sidewall parts **124*a* and 124*b*, resembles a vane which projects radially outwardly and circumferentially (or spirally) partway around the element, with the plurality of side panels 124 and the vanes formed thereby all projecting circumferentially in generally the same direction so as to provide the dunnage element, when viewed in cross section or when viewed from the top or bottom thereof as illustrated by FIGS. 15 and 16**, with a vane wheel or pinwheel configuration.

During the initial forming of the dunnage element 112, as explained hereinafter, the skirt 123 as defined by the circumferentially overlapping side panels 124 will closely resemble a cylindrical configuration since each individual side panel 124 closely and snugly overlaps and embraces the circumferentially adjacent side panel 124. The formed paper blank defining the dunnage element, however, has a natural tendency (i.e., a memory) to return to its original condition and hence the side panels 124 tend to partially open and create the vane appearance depicted by FIGS. 15 and 16. This also results in the skirt assuming a slightly truncated tapered configuration, with the cross section of the skirt increasing slightly as the skirt projects toward the open or free end of the skirt.

A large plurality of dunnage elements 112 are used in the same manner as the dunnage elements 12 described above relative to the first embodiment, and hence a more detailed description as to the use of the dunnage elements 112 is believed unnecessary. These dunnage elements 112, however, provide a highly effective packaging material for cushioning and resiliently supporting articles packed therein since the cup-shaped configuration of the elements 112 and specifically the tightly spirally round skirt, as defined by the plurality of circumferentially overlapping vane-shaped side panels, ensures that a large amount of dead airspace is defined and trapped within each dunnage element, and at the same time the configuration of the dunnage element provides resilient cushioning effect, and the elements can be randomly disposed within a large collection as contained within a confining receptacle such as a box, so as to provide for the desired cushioned support of an article or object which is disposed within the box. At the same time, these dunnage elements 112, by being formed from thin paper material, are easy to handle, ecologically safe, readily disposed of, and inexpensive to manufacture.

Attention is now directed to FIGS. 17–22 which illustrate a forming process and apparatus which can be utilized to form the dunnage element 112. This apparatus includes a punch 142 which cooperates with an extruder 143 to convert the blank 13 into the dunnage element 112.

The extruder 143 includes a platelike head part 151 having a generally flat top surface 152 thereon, and provided with a generally cylindrical opening 153 projecting centrally vertically therethrough. A cross-shaped slot 154 is formed in and projects downwardly from the top surface 152, which slot is formed by four individual slots 155 which project radially outwardly from the central opening 153 in uniformly angularly spaced relation therearound. Each of the slots 155 is defined between generally parallel sidewalls which project outwardly from the central opening 153, with the end of each slot 155 being closed by a generally semi-circular end wall 156. The slot 155 does not project axially through the entire thickness of the head part 151, but rather terminates at a base wall 157 which is spaced upwardly a small distance from the bottom or end surface 158 of the head part 151. The central opening 153 defines arcuate wall portions which extend between and adjoins the circumferentially adjacent slots 155.

The head part 151 has a further cross-shaped slot which communicates with the bottom of the upper cross-shaped slot 154 and projects downwardly for communication with the bottom surface 158. This further cross-shaped slot includes a separate leg or slot 161 which is associated with each of the slots 155. This slot 161 opens downwardly between the walls 157 and 158. Each slot 161 at its inner end communicates with the central opening 153, and then projects radially outwardly therefrom generally along the centerline of the respective slot 155 so as to terminate at a rounded closed end 162. The slot 161 has a width which is significantly smaller than the width of the respective slot 155.

The extruder 143 includes an intermediate part 171 which is fixed to and projects axially downwardly from the head part 151. This intermediate part in turn joins to a lower forming part 181 which also projects axially downwardly from the intermediate part.

The intermediate part 171 defines a surrounding sleeve-like wall structure which includes thereon a plurality of sloped cam surfaces so as to cause the vanes on the dunnage element to be circumferentially deformed generally into a cylindrical shape. For this purpose, the intermediate part 171 includes a plurality of individual camming elements 172 which are positioned in a generally cylindrical arrangement so as to define a generally cylindrical opening extending axially therethrough, which opening may have a slight taper or convergence as it projects axially downwardly. The plurality of camming elements 172, there being four such elements in the illustrated embodiment, are positioned in a sloped relationship so that the upper end of each element 172 is fixed to the underside of the head part 151, and the lower end of each element 172 is fixed to the upper end of the lower part 181. Each element 172 in the illustrated embodiment is formed generally as a cylindrical rod disposed with its axis skewed relative to the parallel opposed mounting surfaces defined on the head part 151 and bottom part 181 so that the outer surface of each element 172 effectively forms a camming or forming surface which is sloped and projects circumferentially as it projects axially downwardly.

The lower forming part 181 includes a forming plate 182 which has a forming opening 183 extending axially therethrough in alignment and communication with the central opening defined in the intermediate part 171. The opening 183 includes an upper generally cylindrical opening 184 which is of a truncated conical configuration and which converges as it projects axially downwardly. This conical opening 184 in turn terminates in a generally cylindrical opening 185 which then projects downwardly through the bottom surface of the plate 182.

The extruder 143 may also optionally be provided with a guide sleeve 186 fixed to and projecting coaxially downwardly from the bottom plate 182. This guide sleeve 186 has a cylindrical opening 187 therethrough which is aligned with and generally equals the diameter of the opening 185.

To permit forming of the dunnage element 112 using the extruder 143, the square paper blank 13 is initially positioned centrally over the top surface 152. The cylindrical plunger 141 is then moved downwardly and contacts the central portion of the blank 13, with further downward movement of the plunger causing the blank to be pushed downwardly into the upper end of the cylindrical opening 153. As this downward pushing continues, the blank is deformed into a generally cup-shaped configuration having an annular sidewall defined by four radially outwardly projecting side panels or vanes similar to FIGS. 2 and 5 above, this configuration initially being assumed due to the presence of the radial slots 155. As the downward pushing of the blank into and through the head part 151 continues, the radially outwardly projecting vanes enter into the narrower slots 161 which cause the vanes to be effectively compressed together and thereby creates a tighter fold adjacent the free end of the vane, which fold corresponds to the fold 125 of FIG. 15.

After the punch moves the partially formed element through the head part 151, the punch continues to push the partially formed element downwardly into and through the intermediate part 171. During its passage through the generally central cylindrical opening defined by the camming elements 172, the folded vanes on the partially formed element contact the sloped exterior cylindrical surfaces of the elements 172 so that the vanes are progressively circumferentially folded over generally on top of one another to form a generally cylindrical configuration as the punch pushes the element axially downwardly through the intermediate part 171.

Thereafter the punch continues to press the element downwardly into and axially through the lower part 181. Upon entering the lower part 181, the base portion of the element is first moved into the conical opening 184 and thence into the smaller cylindrical opening 185. During passage through these cylindrical openings 184 and 185, the deformed paper element is rather tightly confined between the exterior of the punch 143 and the surrounding wall of the cylindrical opening 185, which provides for more effective creasing of the fold lines 125 and 126, and causes the circumferentially and spirally overlapping vanes to be rather tightly compressed into a generally cylindrical configuration. In this condition, the deformed element is then preferably pushed into and through the guide sleeve 186 which retains the deformed element in its cylindrical condition for a somewhat longer period of time so as to minimize the memory effect, namely the expansion which occurs after the dunnage element is pushed out of the extruder.

The forming operation as described above can be carried out without use of steam or moisture. Further, no special treatment of the paper prior to forming is normally required. It is possible, however, to coat the paper with a thin layer of adhesive or glue prior to forming, which adhesive or glue will be permitted to dry prior to forming, since such layer will further increase the stiffness of the paper and the stiffness of the resulting dunnage element. The use of such adhesive or glue, however, is normally not required, and its use is normally not preferred.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. Improvements in a free-flowing dunnage packaging material usable for filling an open region between an article and a surrounding container so that the dunnage packaging material provides for cushioned support of the article within the container, said dunnage packaging material consisting of a large plurality of separate and discrete dunnage packaging elements capable of adopting a haphazard and random orientation when said material is disposed within and substantially fills said open region, the improvement wherein said dunnage element comprises a monolithic one-piece blank consisting of thin paper physically deformed into a cup-shaped element having a generally flat base wall and a substantially annular skirt fixedly joined to said base wall around the periphery thereof and projecting transversely away from said base wall so that said skirt defines therein an open, interior region which is closed at a first end of said skirt by said base wall and which opens outwardly through a second end thereof, said second end of said skirt being defined by a free edge which creates a substantially endless path, said skirt being defined by a plurality of side panels which are individually joined to said base wall and which are serially joined to one another to define a substantially annular configuration, each side panel having a channeled cross section when viewed in a plane substantially parallel to said base wall, said channeled cross section opening in a direction outwardly away from the interior region of the skirt, and sidewardly adjacent pairs of said side panels having adjacent sidewall portions which are integrally joined together by edge portions which are elongated and project outwardly away from the base wall and terminate at said free edge.

2. A dunnage packaging material according to claim 1, wherein said free edge is of a substantially sawtooth configuration.

3. A dunnage packaging material-according to claim 2, wherein said free edge throughout the length thereof is defined by alternating peaks and valleys, and the number of peaks equals the number of side panels.

4. A dunnage packaging material according to claim 3, wherein each side panel includes an inner wall portion which joins to and projects transversely away from the base wall and which in turn joins to an outer wall portion which projects transversely so as to terminate at said free edge, said outer wall portion being of substantially triangular shape so as to terminate at an apex which defines one of said peaks, said peak being the furthestmost point from said base wall.

5. A dunnage packaging material according to claim 3, wherein the annular skirt includes a maximum of four serially-connected side panels.

6. Improvements in a free-flowing dunnage packaging material usable for filling an open region between an article and a surrounding container so that the dunnage packaging material provides for cushioned support of the article within the container, said dunnage packaging material consisting of a large plurality of separate and discrete dunnage packaging elements capable of adopting a haphazard and random orientation when said material is disposed within and substantially fills said open region, the improvement wherein said dunnage elements are individually constructed as a monolithic one-piece member consisting of thin papersheet, said monolithic one-piece member having a cup-shaped configuration defined by a substantially flat base wall having a substantially annular skirt joined to an outer peripheral edge of said base wall and projecting transversely from said base wall, said skirt being defined by a plurality of side wall panels which are individually joined directly to said base wall and are serially joined together, said skirt defining therein an open, interior region which is closed at a first end of said skirt by said base wall and which opens outwardly through a second end thereof.

7. A dunnage package material according to claim 6, wherein the skirt has a configuration which in a plane parallel to the base wall has an endless configuration which includes a plurality of outwardly projecting portions which are disposed uniformly and angularly along said endless configuration.

8. A dunnage packaging material according to claim 7, wherein the endless configuration substantially defines a four-pointed star.

9. A dunnage packaging material according to claim 6, wherein the skirt defines a free edge which is spaced laterally from the base wall and which is of a substantially sawtooth configuration.

10. A dunnage packaging material according to claim 6, wherein each side wall panel, in a plane generally parallel to said base wall, has a shallow channeled cross section which is of a substantially arcuate configuration and opens outwardly away from the hollow interior of the annular skirt.

11. A dunnage packaging material according to claim 10, wherein the skirt terminates in a free edge spaced laterally from the base wall, said free edge being of an undulating configuration, and each said side panel defining a portion of said free edge which defines an undulation which projects outwardly and defines a peak which projects in a direction transversely away from said base wall.

12. A dunnage packaging material according to claim 11, wherein said peak defines a sharp corner and is substantially aligned with a line which projects outwardly from said base wall in substantially bisecting relationship relative to the respective side panel.

13. A dunnage packaging material according to claim 6, wherein said paper member is physically deformed from a single, thin flat blank consisting of paper.

14. A dunnage packaging material according to claim 9, wherein said paper member is physically deformed from a single, thin flat blank consisting of paper.

15. A dunnage packaging material according to claim 7, wherein the endless configuration has a pinwheel-shaped configuration.

16. A dunnage packaging material according to claim 15, wherein each side wall panel of said skirt extends circumferentially of the skirt through a limited angular extent and partially circumferentially overlaps a next adjacent said side wall panel.

17. A dunnage packaging material according to claim 16, wherein each side wall panel includes an outer wall part which is circumferentially elongate and which at one end edge is reversely folded for connection to an inner wall part which partially overlaps the outer wall part, the inner wall part terminating at another edge defined by a reverse fold which connects to an edge of the outer wall part of the next circumferentially-adjacent side wall panel.

18. In a package comprising an outer container having sides, at least one article within said container, and free-flowing shock-absorbing biodegradable dunnage packaging material of claim 12 confined within said container and substantially filling the regions between said article and said sides, said packaging material being defined by a large plurality of individual and discrete dunnage elements.

19. A package according to claim 18, wherein the configuration substantially defines a four-pointed star.

20. A package according to claim 18, wherein each of said side wall panels, in a plane generally parallel to said base wall, has a shallow channeled cross section which is of a generally arcuate configuration and opens outwardly away from the hollow interior of the annular skirt.

21. A package according to claim 18, wherein the skirt terminates in a free edge spaced laterally from the base wall, said free edge being of an undulating configuration, and each said side wall panel defining a portion of said free edge which defines an undulation which projects outwardly and defines a peak which projects in a direction transversely away from said base wall.

22. A package according to claim 21, wherein said peak defines a sharp corner and is substantially aligned with a line which projects outwardly from said base wall in substantially bisecting relationship relative to the respective side wall panel.

23. A package according to claim 18, wherein said skirt has a configuration substantially defining a four-pointed pinwheel.

* * * * *

UNITED STATES PATENT AND TRADEMARK OFFICE

CERTIFICATE OF CORRECTION

PATENT NO. : 5,595,811

DATED : January 21, 1997

INVENTOR(S) : William A. Stout, Jr.

It is certified that error appears in the above-indentified patent and that said Letters Patent is hereby corrected as shown below:

Column 13, line 29; change "material-according" to ---material according---.

Column 14, line 53; change "claim 12" to ---claim 6---.

Column 15, line 6; change " substan " to --- substan- ---.

Signed and Sealed this

Tenth Day of June, 1997

Bruce Lehman

*Attest:*

BRUCE LEHMAN

*Attesting Officer*

*Commissioner of Patents and Trademarks*